US006425573B1

(12) United States Patent
Suzuki

(10) Patent No.: US 6,425,573 B1
(45) Date of Patent: Jul. 30, 2002

(54) CARBURETOR WITH VAPOR PURGE PUMP

(75) Inventor: Masao Suzuki, Igugon Miyagi (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/544,753

(22) Filed: Apr. 7, 2000

(30) Foreign Application Priority Data

Apr. 13, 1999 (JP) ..... 11-105657

(51) Int. Cl.[7] ..... F02M 17/04
(52) U.S. Cl. ..... 261/35; 261/69.1; 261/DIG. 68
(58) Field of Search ..... 261/35, 69.1, 69.2, 261/DIG. 68

(56) References Cited

U.S. PATENT DOCUMENTS

| | | | | | |
|---|---|---|---|---|---|
| 3,177,920 | A | * | 4/1965 | Phillips | 261/35 X |
| 3,208,739 | A | * | 9/1965 | Phillips | 261/35 |
| 3,233,652 | A | * | 2/1966 | Phillips | 261/35 X |
| 3,738,622 | A | | 6/1973 | Tuckey | 261/35 |
| 3,843,755 | A | * | 10/1974 | Tuckey | 261/69.2 |
| 4,055,609 | A | * | 10/1977 | Phelps | 261/DIG. 68 |
| 4,271,093 | A | | 6/1981 | Kobayashi | 261/35 X |
| 4,335,061 | A | | 6/1982 | Kobayashi | 261/DIG. 68 |
| 4,824,613 | A | * | 4/1989 | Scott et al. | 261/DIG. 68 |
| 5,241,931 | A | * | 9/1993 | Radel | 261/DIG. 68 |
| 5,554,322 | A | | 9/1996 | Kobayashi | 261/35 |
| 5,599,484 | A | | 2/1997 | Tobinai | 261/44.2 |
| 5,709,822 | A | | 1/1998 | Togashi | 261/44.2 |
| 5,711,901 | A | | 1/1998 | Berg et al. | 261/35 |

FOREIGN PATENT DOCUMENTS

| | | | | |
|---|---|---|---|---|
| JP | 57-38661 | * | 3/1982 | 261/DIG. 68 |
| JP | 60-125761 | | 7/1985 | |
| JP | 2-37158 | * | 2/1990 | 261/DIG. 68 |
| JP | 3-253758 | * | 11/1991 | 261/DIG. 68 |
| JP | 04339161 | | 11/1992 | |
| JP | 09177614 | | 7/1997 | |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A membrane fuel pump (A) is driven by the pulsating pressure of intake air of an engine. Fuel in the fuel tank (80) is supplied to a constant-pressure fuel chamber (30) through valve (22), and further to an intake passage through a fuel nozzle (16). A membrane purge pump (B) is also driven by the pulsating pressure of the intake air of the engine. A plurality of vapor reservoir chambers **(62*a*–62*c*) are provided in a ceiling of the fuel chamber (30). The fuel vapor in the vapor reservoirs (62*a*–62*c*) is discharged from the fuel chamber (30) and back into the fuel tank (80)** by the membrane purge pump (B).

15 Claims, 3 Drawing Sheets

CARBURETOR WITH VAPOR PURGE PUMP

REFERENCE TO RELATED APPLICATION

Applicant claims the priority of Japanese patent application, Ser. No. 11-105657, filed Apr. 13, 1999.

TECHNICAL FIELD OF THE INVENTION

The present invention relates to a fuel supplying structure of a carburetor for an internal combustion engine which is loaded on a portable working machine such as a reaping machine or a ventilator, particularly a carburetor which can effectively discharge fuel vapor or air within a constant pressure fuel chamber out from the carburetor and back to a fuel tank to assure a an continuous reliable amount of fuel to the engine.

BACKGROUND OF THE INVENTION

The engine loaded in a portable working machine generates great vibration due to its downsizing and high speed revolution. Therefore, because of the heat or vibration generated during engine running, fuel vapor is generated in not only a carburetor but also in a fuel passage from a fuel tank to the carburetor. This may lead to lean-burn continuous abnormal combustion, thus leading to a possible slump of a rotary speed of the engine and possible stoppage of the engine.

In order that the carburetor can continue running irrespective of a status or position change of the engine in any direction, a fuel supplying mechanism of the carburetor includes a constant-pressure fuel chamber partitioned by a diaphragm, for example, rubber or other elastic material. The fuel path or fuel system from the fuel tank to an intake passage via a diaphragm fuel pump, constant-pressure fuel chamber and a fuel nozzle is hermetically sealed with no air vent to the ambient atmosphere. Gasoline serving as the fuel that is vaporized due to heat or vibration of the engine while it flows from the fuel tank to the intake path via the diaphragm fuel pump, constant-pressure fuel chamber, fuel path and fuel nozzle, is stored as fuel vapor in the constant-pressure fuel chamber or fuel path.

The fuel vapor generated in the fuel system, which is formed in a hermetically sealed structure, may be finally supplied to the intake path through the fuel nozzle. The vapor may accompany the liquid fuel and the engine may still run properly. However, if excessive amounts of the fuel vapor are generated, only the fuel vapor maybe supplied to the fuel nozzle. Thus, the engine is subject to acceleration-running or sloping-running status. The supply of fuel to the engine is temporarily stopped so that the speed of the engine may abruptly lower and the engine may be stopped. Once the engine is stopped and when the engine is restarted again, the state where only the fuel vapor is supplied to the intake path continues, thus greatly impairing the performance of the engine. The malfunction of the engine described above is apt to occur during high-loaded running, particularly under a heated condition such as under a burning sun in summer.

In view of the above problem, what is needed is a fuel vapor discharging structure for a carburetor which can always, during engine running, discharge the fuel vapor that builds up in a constant-pressure fuel chamber in a carburetor.

SUMMARY OF THE INVENTION

In accordance with the present invention, there is provided a fuel supplying mechanism for a carburetor in which fuel in a fuel tank is supplied to a constant-pressure fuel chamber through a flow-in valve by a fuel pump which is preferably driven by the pulsating pressure of the intake air in an engine, and further supplied from the constant-pressure fuel chamber to a fuel nozzle projecting into an air intake passage. The fuel supplying mechanism has a purge pump preferably driven by the pulsating pressure of the intake air in the engine. A plurality of vapor reservoir chambers are provided at a higher position at the ceiling wall of the constant-pressure fuel chamber than the inlet of the fuel nozzle. The fuel vapor in the plurality of vapor reservoirs is sucked by the purge pump and discharged out of the fuel chamber. Preferably, the vapor is returned to the fuel tank.

It is also desirable that both the fuel pump and the purge pump are operated by a respective diaphragm. The respective diaphragms are formed from different sections of a single membrane mounted in the carburetor.

A throttle is provided at an outlet path of the purge pump to suppress the flow-out of the fuel as well as the fuel vapor from the constant-pressure fuel chamber into the fuel tank through the purge pump and assure the fuel flowing from the constant-pressure fuel chamber to the fuel nozzle. A check valve is provided in an outlet passage of the purge pump so that the fuel vapor or fuel which is purged from the constant-pressure fuel chamber to the fuel tank is prevented from returning to the constant-pressure fuel chamber via the purge pump.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENT

Figure 1:
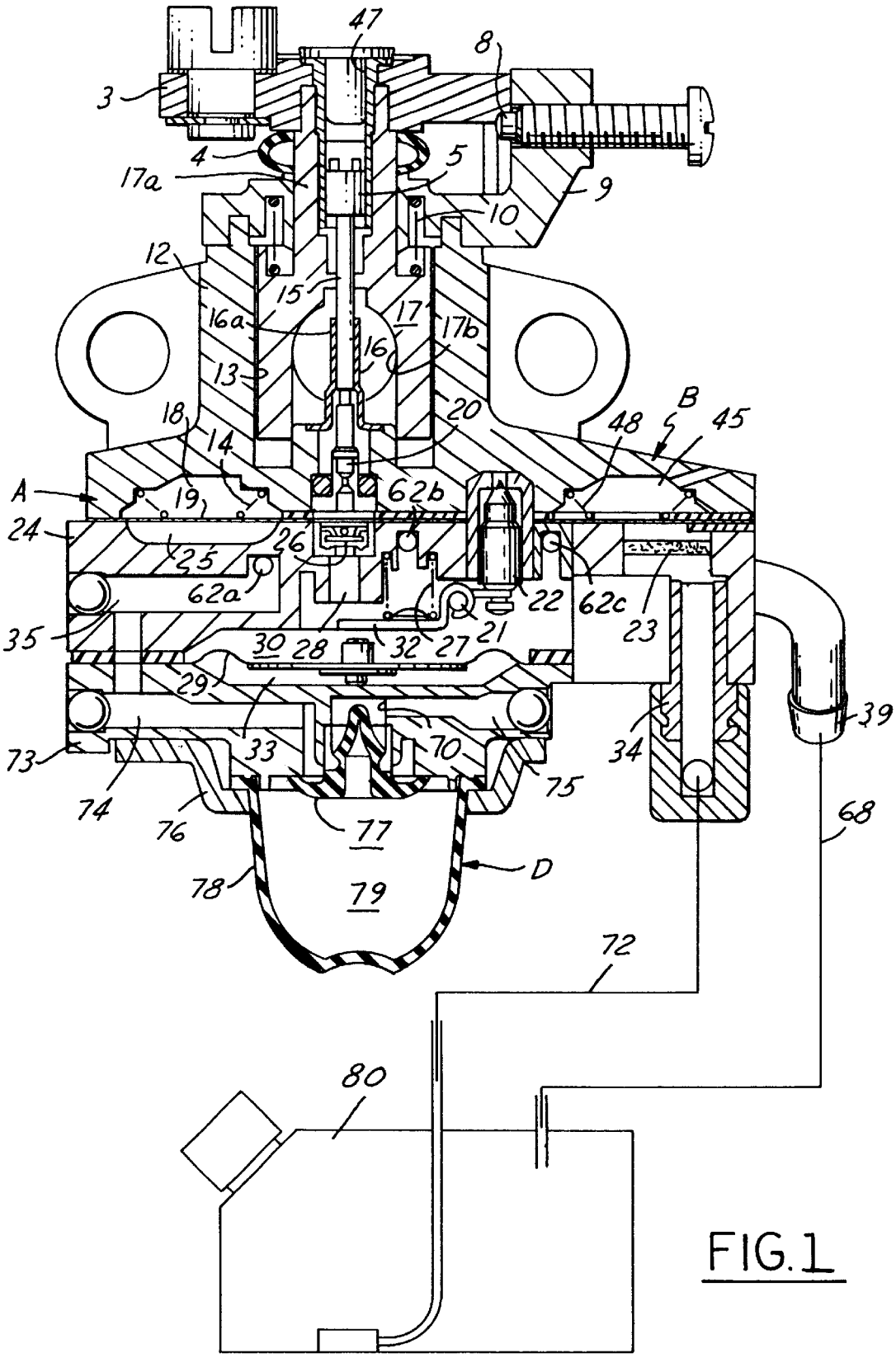
FIG. 1 is a front sectional view of a carburetor provided with a fuel vapor discharging mechanism according to a first embodiment of the invention.

FIG. 1 is a front view of a rotary throttle-valve carburetor provided with a fuel supply mechanism according to the present invention. A body 12 of the carburetor includes an intake path (perpendicular to the plane of the drawings and not shown) crossing a valve chamber or cylinder 13 with its lower end closed. A throttle valve 17 movably fitted both rotatably and axially in the cylinder 13 is provided with a throttle valve hole 17*b* having a cross-sectional shape which can be aligned with the intake path. With the aid of the force of a spring 10 which is mounted between a cover plate 9 closing the upper end of the cylinder 13 and the throttle valve 17, the throttle valve 17 is rotationally urged to a closing position and axially urged downward. A shaft portion 17*a* protruding upward from the throttle valve 17 penetrates through the cover plate 9 and is coupled with a throttle valve lever 3. A dust-removing boot 4 which covers the shaft portion 17*a* is sandwiched between the throttle valve lever 3 and cover plate 9. The throttle valve lever 3 is coupled with a manual acceleration lever (not shown) for operating a portable working machine through a remote cable.

The throttle valve 17 is engaged to a cam mechanism that includes a cam face below the throttle valve lever 3 and a follower upward protruding from the cover plate 9 and moves upwardly against the force of the spring 10 in proportion to the rotating amount of the throttle valve lever 3. At this time, an aligning area (opening degree of the throttle valve 17) between a throttle hole 17*b* and the intake path of the carburetor body 12 increases. At the same time, a needle 15 supported by the throttle valve 17 ascends and adjustably opens a fuel jetting hole 16*a*. Thus, fuel flow corresponds to the opening degree of the throttle valve as fuel is aspirated from the fuel jetting hole 16*a* of the fuel nozzle 16 into the throttle hole 17*b* of the throttle valve 17. The fuel nozzle fits in an attaching hole with a stem attached to the bottom of the cylinder 13 and communicates with a constant-pressure fuel chamber 30 for keeping the fuel at a prescribed pressure through a fuel jet 20 and a check valve 26 which are attached to the bottom wall of the cylinder 13.

The fuel contained in a fuel tank 80 is supplied to the constant-pressure fuel chamber 30 through a diaphragm fuel pump A. The fuel pump operates according to the pulsating pressure of the intake air of a crank chamber or intake tube of the engine. A section of membrane 19 forms the operating diaphragm and is sandwiched between the carburetor body 12 and wall body 24 and separates a pulsating pressure chamber 18 accommodating the spring 14 and a pump chamber 25 from each other. According to the rising or falling change of the diaphragm section of the membrane 19, the fuel in the fuel tank 80 is drawn into the pump chamber 25 through a tube 72 from inlet tube 34, filter 23, a check valve (suction valve) not shown), and a connecting passage. Further, the fuel is supplied from the pump chamber 25 and into the constant-pressure fuel chamber 30 through a check valve (not shown), a connecting passage and a flow-in valve 22.

The constant-pressure fuel chamber 30 is located on the upper side of a diaphragm 29 sandwiched between a wall body 24 and a wall body 73 having an air hole 33*a* connecting the ambient exterior to an air chamber 33 located on the lower side of the diaphragm 29. A lever 32 is supported in the constant-pressure fuel chamber 30 by a supporting shaft 21. The one end of the lever 32 is secured by a flow-in valve 22 and the other end thereof is engaged with the projection at the center of the membrane 29 by force of a spring 27. When the fuel amount is decreased in the constant-pressure fuel chamber 30, the diaphragm 29 and lever 32 are pushed up against the force of the spring 27 because of the atmospheric pressure of the air chamber 33. The lever 32 is rotated clockwise around the supporting shaft 21 to open the flow-in valve 22. Thus, the fuel in the pump chamber 25 is supplied to the constant-pressure fuel chamber 30 through the flow-in valve 22. When the constant-pressure fuel chamber 30 is filled with the fuel, the diaphragm 29 is pushed down. Thus, the lever 32 is rotated counterclockwise around the supporting shaft 21 to close the flow-in valve 22.

A cylinder 47 is fixed in the cylinder provided at the center of the upper end of shaft 17*a* of a throttle valve 17 so that it is not taken off. The upper end of the needle 15 is coupled with a head screwed to the cylinder 47. A coil spring 10 is arranged between the head 5 and the bottom wall of the cylinder of the shaft portion 17*a*. Therefore, if the head 5 is moved by screwing, the relative distance from the lower end of the needle 15 is adjusted. The upper end of the cylinder 47 is covered with a cap (not shown).

The present invention provides a diaphragm purge pump B for purging the fuel vapor in the constant-pressure fuel chamber 30 in addition to the membrane fuel pump A for supplying the fuel from the fuel tank 80 to the constant-pressure fuel chamber 30 so that the fuel vapor in the constant-pressure fuel chamber 30 is always purged by the diaphragm purge pump B during the engine running. In order that the fuel vapor located in the constant-pressure fuel chamber 30 is effectively guided to the fuel tank 80, a plurality of cylinders projecting upward in the ceiling wall of the constant-pressure fuel chamber 30 are made to form vapor reservoirs 62*a*–62*c*. The fuel vapor is guided from the vapor reservoirs 62*a*–62*c* to the diaphragm purge pump B through the internal passage of the wall body 24. Similar to the diaphragm fuel pump A, the diaphragm purge includes a pulsating pressure chamber 45 accommodating a spring 48, which is located on the upper side of the same membrane 19 sandwiched between the vaporizer body 12 and wall body 24. The membrane 19 also has a respective section which functions as an operating diaphragm for the purge pump B. A pump chamber (not shown) is located on the lower side of the membrane 19. The fuel vapor in the vapor reservoir chambers 62*a*–62*c* is guided to the diaphragm purge pump B through a passage (not shown) and an air intake valve (not shown), and returned to the fuel tank 80 through a discharging valve (not shown), an internal passage of the wall body 24, outlet tube 39 and a tube 68.

The diaphragm fuel pump A and diaphragm purge pump B operates on the pulsating pressure in the crank chamber in the case of two-stroke engine and that in a heat-insulating tube between the carburetor and the engine in the case of four strokes. The vapor reservoir chamber 62*a*–62*c* are positioned at a higher position of the ceiling wall of the constant-pressure fuel chamber 30 than an inlet 28 of the fuel nozzle 16. A passage leads from the highest portion of the vapor reservoir chambers 62*a*–62*c* to the pump chamber of the diaphragm purge pump B.

Each of the vapor reservoir chambers 62*a*–62*c* is also in communication with a pump chamber 79 of a manual suction pump D through common passages 35 and 74. The diaphragm purge pump B has preferably a higher pumping capacity. However, if the intake rate of fuel is too great, it may detrimentally affect the fuel rate aspirated from the constant-pressure fuel chamber 30 to the intake passage via the fuel nozzle. Therefore, the passage extending from each of the vapor reservoir chambers 62*a*–62*c* is connected to the pump chamber of the membrane purge pump B through a common throttle jet and check valve.

The suction pump D is attached to the wall body 73, and serves to supply the fuel from the fuel tank 80 to the constant-pressure fuel chamber 30 prior to starting of the engine. The suction pump D is so structured that the hollow shaft portion of a mushroom-shaped composite check valve 77 is fitted in a cylindrical portion provided on the lower face of the wall body 73 and the peripheral edge of a manual purge bulb 78 covering the composite check valve 77 is coupled with the lower face of the wall body 73 by a retaining plate 76 and a bolt. The inlet passage 74 covered with the beveled portion of the composite check valve 77 is connected to each of the vapor reservoir chambers 62*a*–62*c* through a passage 35, and an outlet passage 75 extending from the cylindrical portion 70 is connected to an outlet tube 39 through a connecting passage (not shown). The composite check valve 77 constitutes a suction valve which opens/closes between the inlet passage 74 and pump chamber 79 by the periphery of the beveled portion and a discharging valve which opens/closes between the pump chamber 79 and outlet passage 75 by the flat duckbill shaft portion.

In the fuel vapor discharging mechanism for the carburetor described above, when the suction pump D is operated prior to starting an engine, the check valve 26 at the inlet of the fuel nozzle 16 closes to prevent backflow of air from throttle hole 17*b* and thus the fuel vapor in the vapor reservoir chambers 62*a*–62*c* enters through the passages 35, 74 and the beveled portion of the composite check valve 77. Further, the fuel vapor is discharged to the fuel tank 80 through the shaft portion of the composite check valve 77, cylindrical portion 70, outlet passage 75, a connecting passage (not shown), outlet tube 39 and line 68. Since the pressure in each of the vapor reservoir chambers 62*a*–62*c* and the constant-pressure fuel chamber 30 becomes lower tan the atmospheric pressure, the fuel in the fuel tank 80 is sucked into the pump chamber 25 of the diaphragm fuel pump A through a tube 72, inlet tube 34, filter 23, suction valve and a passage and further sucked into the constant-pressure fuel chamber 30 through a discharge valve, a passage and flow-in valve 22.

During the engine running, the diaphragm fuel pump A and diaphragm purge pump B are driven all the time. Specifically, the fuel in the fuel tank 80 is sucked into the pump chamber 25 through the tube 72, inlet tube 34, filter 23, inlet valve, and passage, and further sucked into the constant-pressure fuel chamber 30 through an outlet valve, passage and flow-in valve 22. On the other hand, the fuel vapor in the constant-pressure fuel chamber 30 is contained in the vapor reservoir chambers 62*a*–62*c* and further sucked into the pumping chamber of the diaphragm purge pump B through the passage, throttle and inlet valve (not shown). The fuel vapor is further discharged into the fuel tank 80 through the discharge valve (not shown), internal passage of the wall body 24, outlet tube 39 and line 68. The vapor reservoir chambers 62*a*–62*c* are arranged in the ceiling wall of the constant-pressure fuel chamber 30 at positions higher than the inlet 28 of the fuel nozzle 16. Therefore, the fuel in the constant-pressure fuel chamber 30 may flow from the inlet 28 into the fuel nozzle 16 through the check valve 26. Further, the fuel vapor in the vapor reservoir chambers 62*a*–62*c* is sucked into the pumping chamber of the membrane purge pump B through their highest portion so that the fuel vapor in the constant-pressure fuel chamber 30 does not flow into the fuel nozzle 16 through the check valve 26, but a reliable flow of liquid fuel is always supplied into the fuel nozzle 16 from the constant-pressure fuel chamber 30 irrespective of the running condition of the engine.

Figure 2:
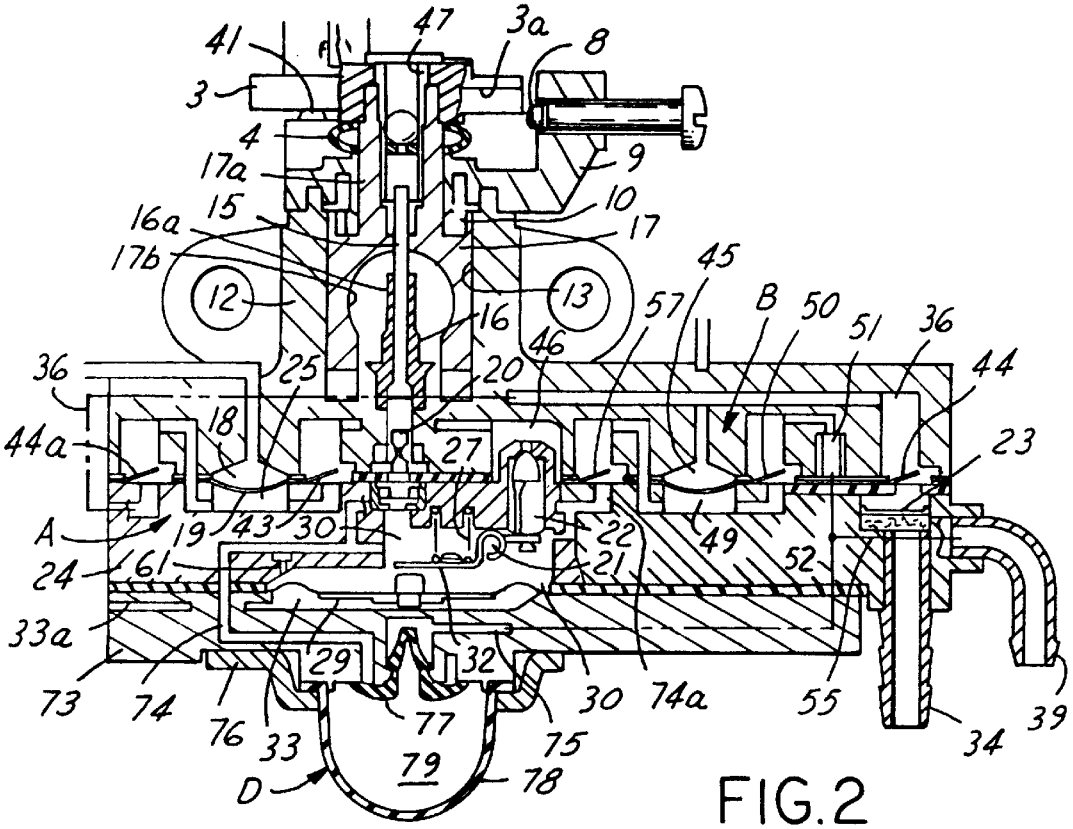
FIG. 2 is a front sectional view of a carburetor provided with a fuel vapor discharging mechanism according to a second embodiment of the invention.

An embodiment shown in FIG. 2 shows the configuration of the membrane fuel pump A, membrane purge pump B and passages. In FIG. 2, like reference numerals refer to like elements in FIG. 1. The fuel in the fuel tank 80 is sucked into the pumping chamber 25 of the membrane fuel pump A through the tube 34, filter 23, check valve 44, passage 36 and inlet valve 44*a*, and further supplied into the constant-pressure fuel chamber 30 through a discharge valve 43, passage 46 and flow-in valve 22. Prior to starting the engine, when the purge bulb 78 of the suction pump D is repeatedly pressed and released, the fuel vapor and air in the constant-pressure fuel chamber 30 are sucked into the pump chamber 79 of the suction pump D through a plurality of vapor reservoir chambers in the ceiling wall of the constant-pressure fuel chamber 30, vapor outlet 61, passage 74 and composite check valve 74. Further, they are discharged into the fuel tank 80 through a composite check valve 77, passages 75, 55, outlet tube 39 and line 68 (FIG. 1). In this case, the check valve 26 (FIG. 1) at the inlet 28 (FIG. 1) of the fuel nozzle 16 is closed and hence the constant-pressure fuel chamber 30 falls into a negative pressure. Therefore, the constant-pressure fuel chamber 30 is filled with the fuel from the fuel tank 80 through the inlet tube, filter 23, check valve 44, passage 36, inlet valve 44*a*, pump chamber 25 of the diaphragm fuel pump A, discharge valve 43, passage 46 and flow-in valve 22.

At the same time as the starting operation of the engine (cranking), the fuel in the constant-pressure fuel chamber 30 is sucked into the intake passage through the check valve 26 (FIG. 1) at the inlet 28 of the fuel nozzle 16, fuel jet 20, fuel jetting hole 16*a* of the fuel nozzle 16 and throttle valve 17. On the other hand, the fuel vapor in the constant-pressure fuel chamber 30 is sucked into the pump chamber 49 of the diaphragm purge pump through a plurality of vapor inlets 61 integrally provided with a throttle, passage 74*a* and inlet valve 57. Further, the fuel vapor is discharged back into the fuel tank 80 through a discharge valve 50, throttle 51, passages 52, 55, outlet tube 39 and line 68. The throttle 51 arranged in the outlet passage 52 of the membrane purge pump B limits the discharging rate of the fuel vapor, thus preventing the fuel from being discharged together with the fuel vapor from the constant-pressure fuel chamber 30 and the fuel to be supplied from the constant-pressure fuel chamber 30 via the fuel nozzle 16 to the engine from becoming insufficient.

Figure 3:
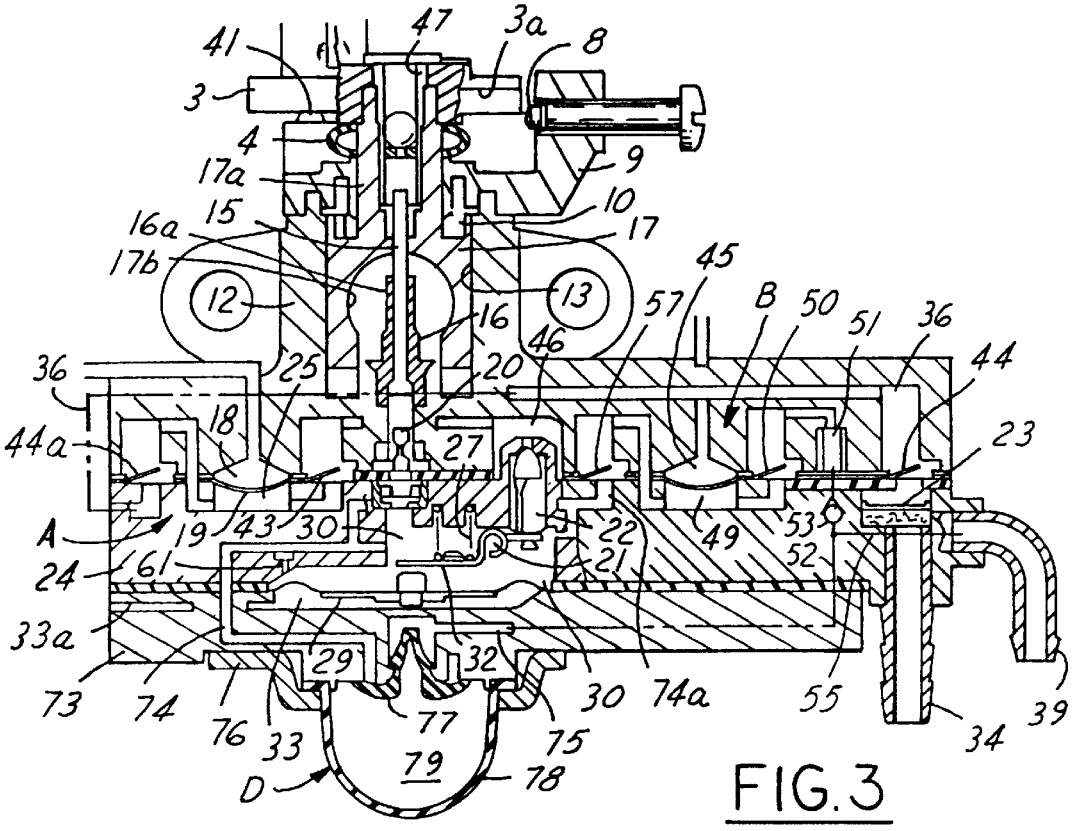
FIG. 3 is a front sectional view of a membrane vaporizer provided with a fuel vapor discharging mechanism according to a third embodiment of the invention.
Figure 4:
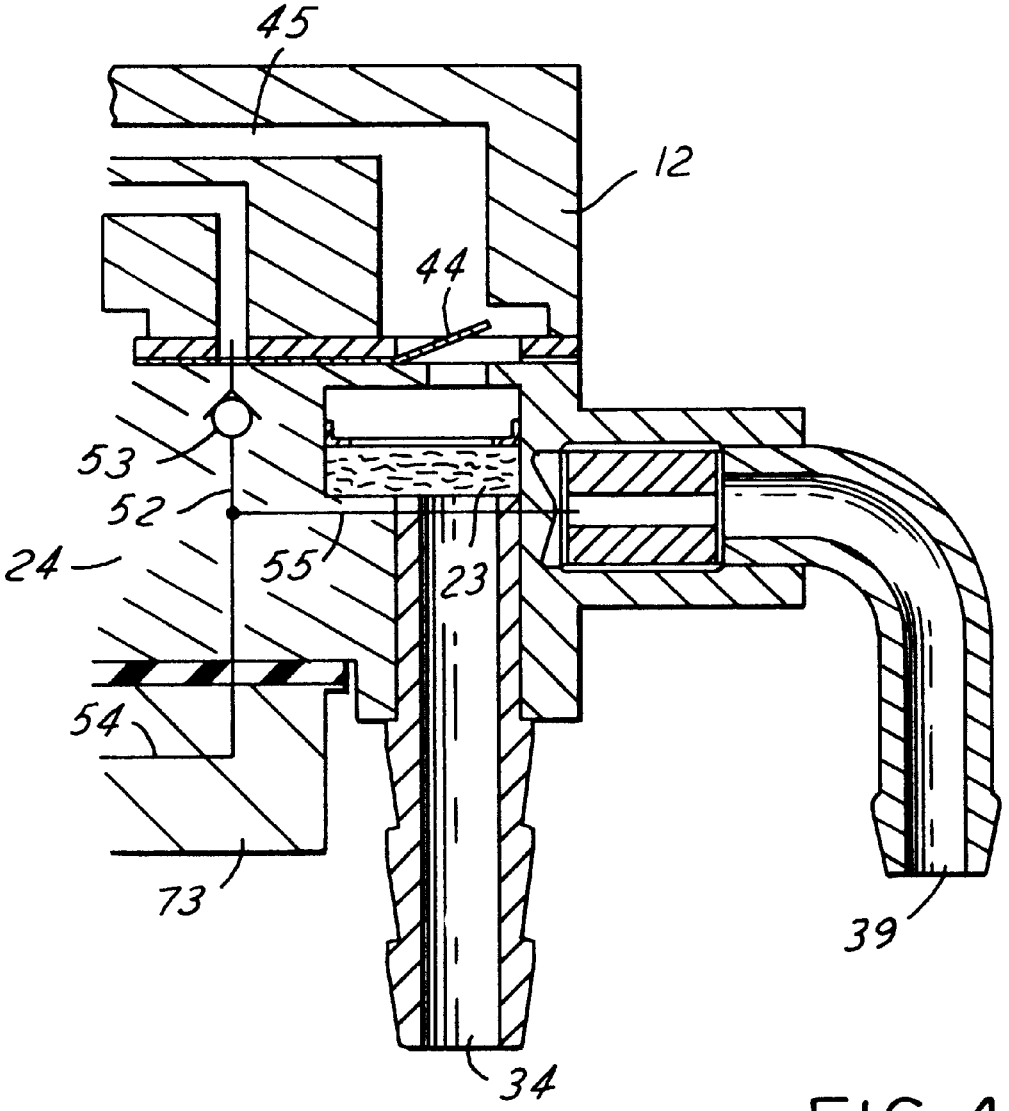
FIG. 4 is an enlarged fragmentary front sectional view of the carburetor shown in FIG. 3.

In embodiments shown in FIGS. 3 and 4, a manual suction pump D is provided between the constant-pressure fuel chamber 30 and fuel tank 80; an outlet passage 75 of the suction pump D and outlet passage 52 of the diaphragm purge pump B are connected to a common tube 39; and a check valve 53 for stopping the flow of fuel from the outlet passage 75 of the manual suction pump D to the outlet passage 52 of the diaphragm purge pump B is provided. The remaining configuration is the same as that of the embodiment of FIG. 2. The check valve 53 of the outlet passage 52 of the diaphragm purge pump B, when the manual suction pump D is operated, prevents the fuel vapor to be discharged from the constant-pressure fuel chamber 30 into the fuel tank 80 and a part of the fuel from being returned to the constant-pressure fuel chamber 30 through the diaphragm purge pump B.

As understood from the description hitherto made, during the engine running, the diaphragm purge pump B is always driven and the fuel vapor in the constant-pressure fuel chamber 30 is discharged into the fuel tank 80 through the vapor reservoir chambers in the ceiling wall. This overcomes the stoppage problem of the fuel supply to engine due to the change in the status or condition of the engine and attendant malfunction of the engine.

In the embodiments described above, the explanation was made on the case of a rotary throttle-valve diaphragm carburetor. However, the present invention should not be limited to the carburetor of such a system, but can be applied to a carburetor of another system.

In this fashion, in the carburetor according to the present invention in which fuel in a fuel tank is supplied into a constant-pressure fuel chamber through a flow-in valve by a diaphragm fuel pump which is driven by the pulsating pressure of the intake air in an engine, and further supplied from the constant-pressure fuel chamber to a fuel nozzle projecting into an air intake passage, a diaphragm purge pump driven by the pulsating pressure of the intake air in the engine is provided. A plurality of vapor reservoir chambers are also provided at the ceiling wall of the constant-pressure fuel chamber at a higher position than the inlet of the fuel nozzle, and the fuel vapor in the plurality of vapor reservoirs is sucked by the diaphragm purge pump and supplied back to the fuel tank. Such a configuration provides the following effects.

During the engine runing, the fuel vapor is forcibly returned to the fuel tank from the highest position of the constant-pressure fuel chamber by the diaphragm purge pump. Therefore, the tendency of the fuel vapor staying in the fuel passage and constant pressure fuel chamber can be suppressed, and hence, during high-loaded running under a burning sun, the liquid fuel in the constant pressure fuel chamber can be continuously and reliably supplied to the engine. Thus, continuous running can be realized in a slanted position of the engine or in abrupt accelerating operation.

The fuel vapor in the constant-pressure fuel chamber is discharged from a location of the constant-pressure fuel chamber that is higher than the inlet of the fuel nozzle and a throttle is arranged in the outlet passage of the diaphragm purge pump to control the rate of discharge. Therefore, the rate of fuel supplied to the engine from the constant-pressure fuel chamber through the fuel nozzle is not affected.

At the time of engine starting, since the fuel vapor in the constant-pressure fuel chamber can be discharged into the fuel tank by the operation of the manual suction pump, the starting performance of the engine can be improved, and continuous and reliable running can be achieved in a slanted position of the engine or in abrupt accelerating operation. Particularly, since the check valve is provided in the outlet passage of a diaphragm purge pump, the fuel vapor discharged by the manual suction pump will not flow backward toward the constant pressure fuel chamber via the diaphragm purge pump.

Variations and modifications are possible without departing from the scope and spirit of the present invention as defined by the appended claims.

I claim:

1. In a carburetor for an engine with the carburetor having a fuel supplying mechanism in which fuel in a fuel tank is supplied to a constant-pressure fuel chamber through a flow-in valve by a fuel pump, and further supplied from the constant-pressure fuel chamber to an inlet of a fuel nozzle opening into an air intake passage of the carburetor, the fuel supplying mechanism comprising:

a purge pump, a fuel opening to the constant pressure fuel chamber through which the inlet of the fuel nozzle communicates with the constant pressure fuel chamber, a plurality of vapor reservoir chambers each opening into the ceiling wall of the constant pressure fuel chamber at spaced-apart locations with the opening of each vapor reservoir chamber being at a higher position than the fuel opening to the inlet of the fuel nozzle, a vapor port opening into each vapor reservoir chamber, the purge pump communicating with the vapor port in each reservoir chamber, and the fuel vapor in the plurality of vapor reservoir chambers is removed through the vapor ports by the operation of said purge pump and discharged through a passage out of said carburetor.

2. A fuel supplying mechanism as defined in claim 1 wherein said purge pump has an operating diaphragm that is driven by pulsating pressure of the intake air of the engine.

3. A fuel supplying mechanism as defined in claim 2 wherein said discharge passage is connected to said fuel tank to deliver said fuel vapor back to said fuel tank.

4. A fuel supplying mechanism as defined in claim 3 wherein a throttle for restricting a discharging flow rate of fuel vapor is arranged in an outlet passage in said purge pump.

5. A fuel supplying mechanism as defined in claim 3 wherein a manual suction pump is provided between the constant-pressure fuel chamber and fuel tank, an outlet passage of the suction pump and outlet passage of the purge pump are connected to a common discharge passage, and a check valve for stopping the flow of fuel from the outlet passage of the suction pump to the outlet passage of the purge pump is provided.

6. A fuel supplying mechanism as defined in claim 2 wherein a throttle for restricting a discharging flow rate of fuel vapor is arranged in an outlet passage in said purge pump.

7. A fuel supplying mechanism as defined in claim 2 wherein a manual suction pump is provided between the constant-pressure fuel chamber and fuel tank, an outlet passage of the suction pump and outlet passage of the purge pump are connected to a common discharge passage, and a check valve for stopping the flow of fuel from the outlet passage of the suction pump to the outlet passage of the purge pump is provided.

8. A fuel supplying system as defined in claim 2 wherein said fuel pump has an operating diaphragm that is driven by pulsating pressure of the intake air of the engine and wherein the diaphragm of said fuel pump and the diaphragm of said purge pump are different sections of a single membrane element mounted in said carburetor.

9. A fuel supplying mechanism as defined in claim 8 wherein a throttle for restricting a discharging flow rate of fuel vapor is arranged in an outlet passage in said purge pump.

10. A fuel supplying mechanism as defined in claim 8 wherein a manual suction pump is provided between the constant-pressure fuel chamber and fuel tank, an outlet passage of the suction pump and outlet passage of the purge pump are connected to a common discharge passage, and a check valve for stopping the flow of fuel from the outlet passage of the suction pump to the outlet passage of the purge pump is provided.

11. A fuel supplying mechanism as defined in claim 1 wherein a throttle for limiting a discharging amount of fuel vapor is arranged in an outlet passage in said purge pump.

12. A fuel supplying mechanism as defined in claim 1 wherein a manual suction pump is provided between the constant-pressure fuel chamber and fuel tank, an outlet passage of the suction pump and outlet passage of the purge pump are connected to a common discharge passage, and a check valve for stopping the flow of fuel from the outlet passage of the suction pump to the outlet passage of the purge pump is provided.

13. In a carburetor for an engine with the carburetor having a fuel supply mechanism in which fuel from a fuel tank is supplied to a constant pressure fuel chamber through an in-flow valve by a fuel pump, and further supplied from the constant-pressure fuel chamber to an inlet of a fuel nozzle for discharging fuel into an air intake passage of the carburetor, the fuel supply mechanism comprising:

a purge pump, a fuel opening to the constant pressure fuel chamber through which the inlet of the fuel nozzle communicates with the constant pressure fuel chamber, at least one vapor reservoir chamber immediately adjacent and opening into the ceiling wall of the constant-pressure chamber and at a higher position therein than the fuel opening inlet of the fuel nozzle, a vapor port opening into the vapor reservoir chamber, the purge pump communicating with the vapor port, and fuel vapor in the at least one vapor reservoir chamber is removed through the vapor port by operation of the purge pump and discharged through a passage out of the carburetor during operation of the carburetor and engine.

14. A fuel supply mechanism as defined in claim 13 wherein the purge pump has an operating diaphragm that is driven by pulsating pressure of the intake air of the engine and the fuel pump has an operating diaphragm that is driven by pulsating pressure of the intake air of the engine.

15. A fuel supply mechanism as defined in claim 14 wherein the diaphragm of the fuel pump and the diaphragm of the purge pump are different sections of the same membrane element mounted in the carburetor.

* * * * *